US012486078B2

(12) United States Patent
Patel

(10) Patent No.: US 12,486,078 B2
(45) Date of Patent: Dec. 2, 2025

(54) MULTI-COMPARTMENT CONTAINERS

(71) Applicant: Nicoventures Trading Limited, London (GB)

(72) Inventor: Pankaj Patel, Clemmons, NC (US)

(73) Assignee: Nicoventures Trading Limited, London (GB)

( * ) Notice: Subject to any disclaimer, the term of this patent is extended or adjusted under 35 U.S.C. 154(b) by 469 days.

(21) Appl. No.: 17/205,176

(22) Filed: Mar. 18, 2021

(65) Prior Publication Data

US 2022/0297893 A1 Sep. 22, 2022

(51) Int. Cl.

| | |
|---|---|
| ***B65D 33/25*** | (2006.01) |
| ***B65D 30/08*** | (2006.01) |
| ***B65D 30/22*** | (2006.01) |
| ***B65D 33/00*** | (2006.01) |
| ***B65D 33/18*** | (2006.01) |

(52) U.S. Cl.

CPC ..... *B65D 33/2566* (2013.01); *B65D 31/02* (2013.01); *B65D 31/12* (2013.01); *B65D 33/004* (2013.01); *B65D 33/18* (2013.01)

(58) Field of Classification Search

CPC .... B65D 33/2566; B65D 31/02; B65D 31/12; B65D 33/004; B65D 33/18

USPC ..... 383/38–40, 61.2

See application file for complete search history.

(56) References Cited

U.S. PATENT DOCUMENTS

| | | | | |
|---|---|---|---|---|
| 1,214,282 A * | 1/1917 | Day | B60R 11/00 | 224/236 |
| 4,648,860 A * | 3/1987 | Cassey | B65D 27/00 | 229/72 |
| 4,838,429 A | 6/1989 | Fabisiewicz et al. | | |
| 4,993,844 A * | 2/1991 | Robinson | B65D 31/12 | 383/38 |
| 5,007,744 A * | 4/1991 | Scarberry | B65D 75/46 | 383/37 |
| 5,024,536 A * | 6/1991 | Hill | B65D 31/12 | 383/38 |
| 5,102,234 A * | 4/1992 | Levy | A61B 10/0096 | 383/209 |
| 5,116,301 A | 5/1992 | Robinson et al. | | |
| 5,222,813 A | 6/1993 | Kopp et al. | | |
| 6,440,051 B1 * | 8/2002 | Lauzon | B31B 70/00 | 383/204 |

(Continued)

FOREIGN PATENT DOCUMENTS

| | | |
|---|---|---|
| EP | 2865514 A1 | 4/2015 |
| FR | 2479149 A1 * | 10/1981 |

(Continued)

OTHER PUBLICATIONS

Machine translation of JP-2012091444-A.*

(Continued)

*Primary Examiner* — Jes F Pascua

(74) *Attorney, Agent, or Firm* — Womble Bond Dickinson (US) LLP; Chris Humphrey; John V. Forcier

(57) ABSTRACT

The present disclosure is directed to various multi-compartment containers, such as, for example, packets, packages, pouches, bags, sacks, cases, or sachet-type containers including, for example, a product compartment and a waste compartment, along with related methods for manufacturing such packages.

10 Claims, 8 Drawing Sheets

(56) References Cited

U.S. PATENT DOCUMENTS 6,719,140 B1 * 4/2004 Rinsler ..... A45C 11/20 206/541
7,861,728 B2 1/2011 Holton, Jr. et al.
8,828,895 B2 9/2014 Foss et al.
9,011,004 B2 * 4/2015 Paulin ..... B65D 33/2566 383/64
10,856,573 B2 12/2020 Pijnenburg et al.
2002/0067865 A1 * 6/2002 Stutzman ..... B65D 33/2508 383/38
2003/0068101 A1 * 4/2003 Huseman ..... B65D 33/20 383/38
2003/0198721 A1 * 10/2003 Price ..... B65D 33/2541 426/393
2003/0236159 A1 * 12/2003 Worthy, Jr. ..... B65D 33/08 493/394
2004/0179754 A1 9/2004 Taheri
2005/0111764 A1 * 5/2005 Solder ..... B65D 33/2508 383/38
2007/0206888 A1 * 9/2007 Chang ..... B65D 33/2508 383/200
2007/0274615 A1 11/2007 Deniaud et al.
2008/0063324 A1 3/2008 Bernard et al.
2008/0107781 A1 5/2008 Carroll
2008/0240623 A1 * 10/2008 Bell ..... B65D 33/01 383/5
2008/0302682 A1 12/2008 Engstrom et al.
2010/0142862 A1 * 6/2010 Sam ..... B65D 33/2566 383/38
2010/0159096 A1 * 6/2010 Sam ..... B65D 33/2591 426/394
2010/0262273 A1 10/2010 Dose et al.
2010/0300465 A1 12/2010 Zimmerman
2011/0240048 A1 10/2011 Winterson et al.
2017/0050763 A1 2/2017 Gharibjanians et al.
2018/0037371 A1 * 2/2018 Perkins ..... B65D 33/2566
2018/0098663 A1 * 4/2018 Wangler ..... B65B 5/045
2018/0148228 A1 * 5/2018 Bray ..... B65D 33/2541
2019/0183174 A1 6/2019 Besso et al.
2020/0214337 A1 7/2020 Evans et al.

FOREIGN PATENT DOCUMENTS

JP 2012091444 A * 5/2012
WO 2001022839 A1 4/2001
WO WO-2004002852 A1 * 1/2004 ..... B65D 75/008
WO 2005102863 A1 11/2005
WO 2007036714 A1 4/2007
WO 2017051165 A1 3/2017

OTHER PUBLICATIONS

Machine translation of FR-2479149-A1.*
Machine translation of WO-2004002852-A1.*
World Intellectual Property Organization, International Search Report, May 11, 2022.

* cited by examiner

MULTI-COMPARTMENT CONTAINERS

TECHNOLOGICAL FIELD

The present disclosure relates to containers, such as, for example, packets, packages, pouches, bags, sacks, cases, or sachet-type containers that include multiple compartments, such as a main compartment for holding a product, such as for example, a smokeless tobacco product or an oral product, and an integral waste compartment.

BACKGROUND

Smokeless tobacco is used herein to denote any tobacco product for oral use which is not intended for combustion, but is intended to be placed in the oral cavity of a user (e.g., between a user's lip or check and their gums and/or chewed) for a period of time, during which there is contact between the user's saliva and the product. Smokeless tobacco includes, for example, chewing tobacco and snus, where one may be in a loose form or portioned into small pouches. Smokeless tobacco is a commonly stored in resealable pouches or sachets. These pouches are typically made from laminated plastic films that include a closure mechanism, such as a Zip-lock® type mechanism.

After the product is used, certain issues arrive with discarding of the used tobacco, in particular with respect to the user's surroundings and the environment. Many users prefer to discard the used product in a discrete fashion and in a way that the waste does not foul the environment. Additionally, the used product is frequently moist and emits a brownish liquid that can stain certain materials (e.g., textiles), so placing the used product directly in one's pocket is not a sensible solution. Unfortunately, there are rarely suitable receptacles available for discarding the product. Some hard sided containers accommodate storage of the used product in a compartment in the lid of the container; however, containers having a lid with a sealable compartment for disposal of used product increases the cost and complexity of producing the container.

Thus, advances with respect to containers or other packaging devices that include a product compartment and a waste compartment would be desirable.

BRIEF SUMMARY

Example implementations of the present disclosure are directed to the concept of a container or other packaging devices (e.g., packets, pouches, bags, sacks, cases, sachets, etc.) including multiple compartments configured to hold different products.

The present disclosure includes, without limitation, the following example implementations.

Some example implementations provide a multi-compartment container including a front panel and a back panel, each having a perimeter defined by two lateral sides and first and second longitudinal ends, where the perimeter of the back panel is sealingly coupled to the perimeter of the front panel along their respective lateral sides, thereby defining an inner cavity and a first open end defined by the first longitudinal end of the front panel and the first longitudinal end of the back panel and a second open end defined by the second longitudinal end of the front panel and the second longitudinal end of the back panel. The container further includes a first closure mechanism disposed proximate the first open end and configured to transition the first open end between an open configuration and a closed configuration, a second closure mechanism disposed proximate the second open end and configured to transition the second open end between an open configuration and a closed configuration, and a divider wall that extends between the sealed lateral sides of the front and back panels and is configured to divide the inner cavity into a first compartment accessible via the first closure mechanism and a second compartment accessible via the second closure mechanism.

In some example implementations of the container of any preceding example implementation, or any combination of any preceding example implementations, the closure mechanisms include one or more of a zipper-type closure, a snap-fit mechanism, an adhesive, or a hook and loop fastener. In addition, the divider wall may be formed via sonic welding or heat sealing between the front panel and the second panel; a process that may also be used for sealing the perimeters of the front and back panels. In some implementations, the front and back panels are made up of a lamination of at least three layers, where, for example, the three layers include an outer printing layer made of a polyester, a high moisture barrier middle layer made of a metalized polyester, and an inner sealing layer made of a low density polyethylene. A surface of the front panel and/or a surface of the back panel may be configured to be printed with indicia, such as an ornamental design, identifying information, or a date code. The indicia may include one or more of a letter, a number, a symbol, a color, or any combination thereof to indicate a function.

In some example implementations of the container of any preceding example implementation, or any combination of any preceding example implementations, the container further comprises a first seal disposed between the lateral sides of the front and back panels and positioned between the first closure mechanism and the first longitudinal ends. The seal includes a tear open feature for accessing the first closure mechanism and the first compartment. The container further includes a second seal disposed between the lateral sides of the front and back panels and positioned between the second closure mechanism and the second longitudinal ends. The second seal includes a tear open feature for accessing the second closure mechanism and the second compartment. In various implementations, the first compartment has a first volume and the second compartment has a second volume that is less than the volume of the first compartment, for example, about 90%, 80%, 70%, 60%, 50%. The first compartment is configured to hold a fresh product (e.g., a smokeless tobacco product or an oral product) and the second compartment is configured to hold a waste product (e.g., a used smokeless tobacco product or an oral product).

Some additional example implementations provide a multi-compartment container including a front panel and a back panel, each panel having a perimeter defined by two lateral sides and first and second longitudinal ends, where the perimeter of the back panel is sealingly coupled to the perimeter of the front panel along their respective lateral sides and second longitudinal ends, thereby defining a first compartment and a first open end defined by the first longitudinal end of the front panel and the first longitudinal end of the back panel. The container further includes an intermediate panel also having a perimeter defined by two lateral sides and first and second longitudinal ends, where the lateral sides and the second longitudinal end of the intermediate panel are sealingly coupled to a surface (e.g., an interior surface or an exterior surface) of either the front panel or the back panel, thereby defining a second compartment and a second open end. The container includes at least one closure mechanism that is disposed proximate the first open end of the first compartment and the second open end of the second compartment, such that the at least one closure mechanism is configured to transition the first open end between an open configuration and a closed configuration of the front panel relative to the back panel and the second open end between an open configuration and a closed configuration of the intermediate panel relative to the surface of the front or back panel.

In some example implementations of the container of any preceding example implementation, or any combination of any preceding example implementations, the at least one closure mechanism includes a first closure mechanism disposed proximate the first open end of the first compartment and configured to transition the first open end between the open configuration and the closed configuration and a second closure mechanism disposed proximate the second open end of the second compartment and configured to transition the second open end between the open configuration and the closed configuration. In various implementations, the second compartment may be located within the first compartment or outside and adjacent to the first compartment depending on the location of the intermediate panel. For example, the intermediate panel may be sealingly coupled to an interior surface of the front panel, an exterior surface of the front panel, an interior surface of the back panel, or an exterior surface of the back panel. In some cases, the perimeter of the intermediate panel is smaller than the perimeters of the front and back panels, while in others the width of the intermediate panel is substantially similar to a width of the front panel and a width of the back panel, while a length of the intermediate panel is less than a length of the front panel and a length of the back panel.

In some example implementations of the container of any preceding example implementation, or any combination of any preceding example implementations, the closure mechanisms include one or more of a zipper-type closure, a snap-fit mechanism, an adhesive, or a hook and loop fastener. In addition, the intermediate panel may be coupled to the front and or back panel via sonic welding, heat sealing or an adhesive. In some implementations, the front, the back, and the intermediate panels are made up of a lamination of at least three layers, where, for example, the three layers include an outer printing layer made of a polyester, a high moisture barrier middle layer made of a metalized polyester, and an inner sealing layer made of a low density polyethylene. A surface of the front panel and/or a surface of the back panel may be configured to be printed with indicia, such as an ornamental design, identifying information, or a date code. The indicia may include one or more of a letter, a number, a symbol, a color, or any combination thereof to indicate a function. In various implementations, the first compartment has a first volume and the second compartment has a second volume that is less than the volume of the first compartment, for example, about 90%, 80%, 70%, 60%, 50%. The first compartment is configured to hold a fresh product (e.g., a smokeless tobacco product or an oral product) and the second compartment is configured to hold a waste product (e.g., a used smokeless tobacco product or an oral product).

These and other features, aspects, and advantages of the present disclosure will be apparent from a reading of the following detailed description together with the accompanying figures, which are briefly described below. The present disclosure includes any combination of two, three, four or more features or elements set forth in this disclosure, regardless of whether such features or elements are expressly combined or otherwise recited in a specific example implementation described herein. This disclosure is intended to be read holistically such that any separable features or elements of the disclosure, in any of its aspects and example implementations, should be viewed as combinable, unless the context of the disclosure clearly dictates otherwise.

It will therefore be appreciated that this Brief Summary is provided merely for purposes of summarizing some example implementations so as to provide a basic understanding of some aspects of the disclosure. Accordingly, it will be appreciated that the above described example implementations are merely examples and should not be construed to narrow the scope or spirit of the disclosure in any way. Other example implementations, aspects and advantages will become apparent from the following detailed description taken in conjunction with the accompanying figures which illustrate, by way of example, the principles of some described example implementations.

BRIEF DESCRIPTION OF THE FIGURES

Figure 1A:
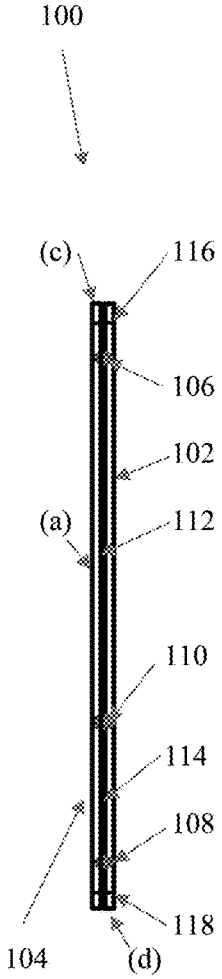
Figure 1B:
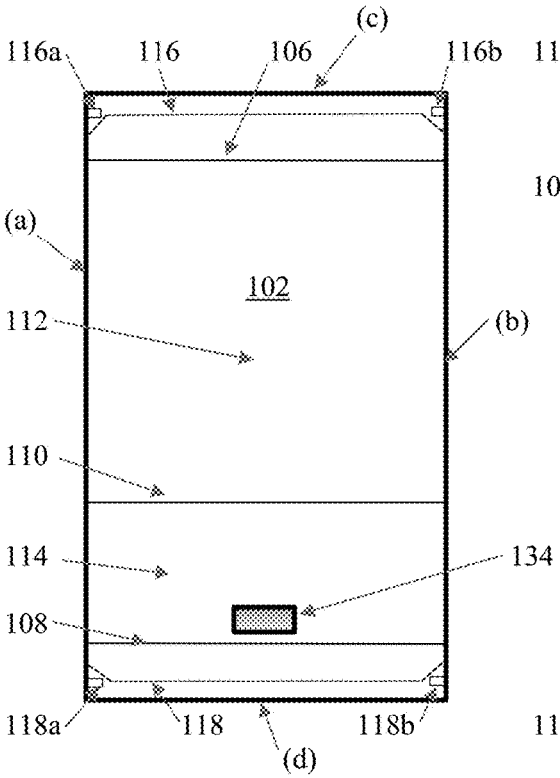
Figure 1C:
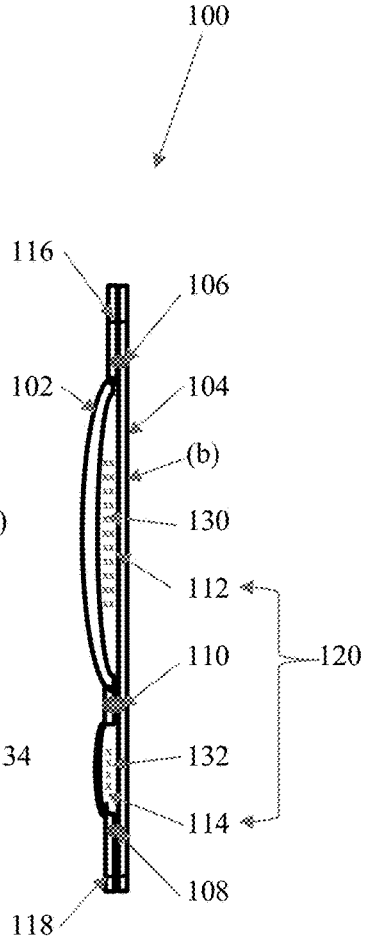
Figure 2A:
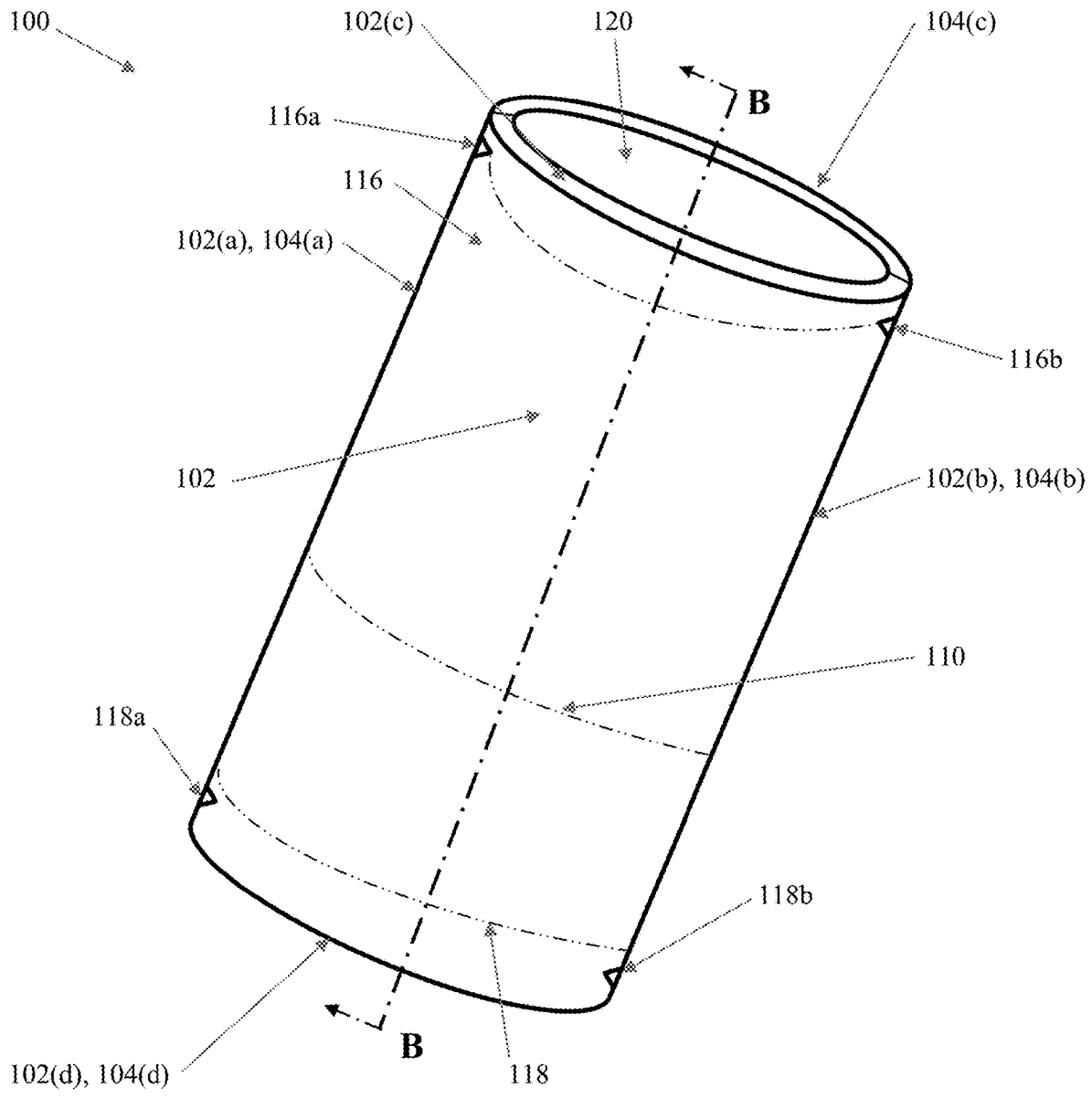
Figure 2B:
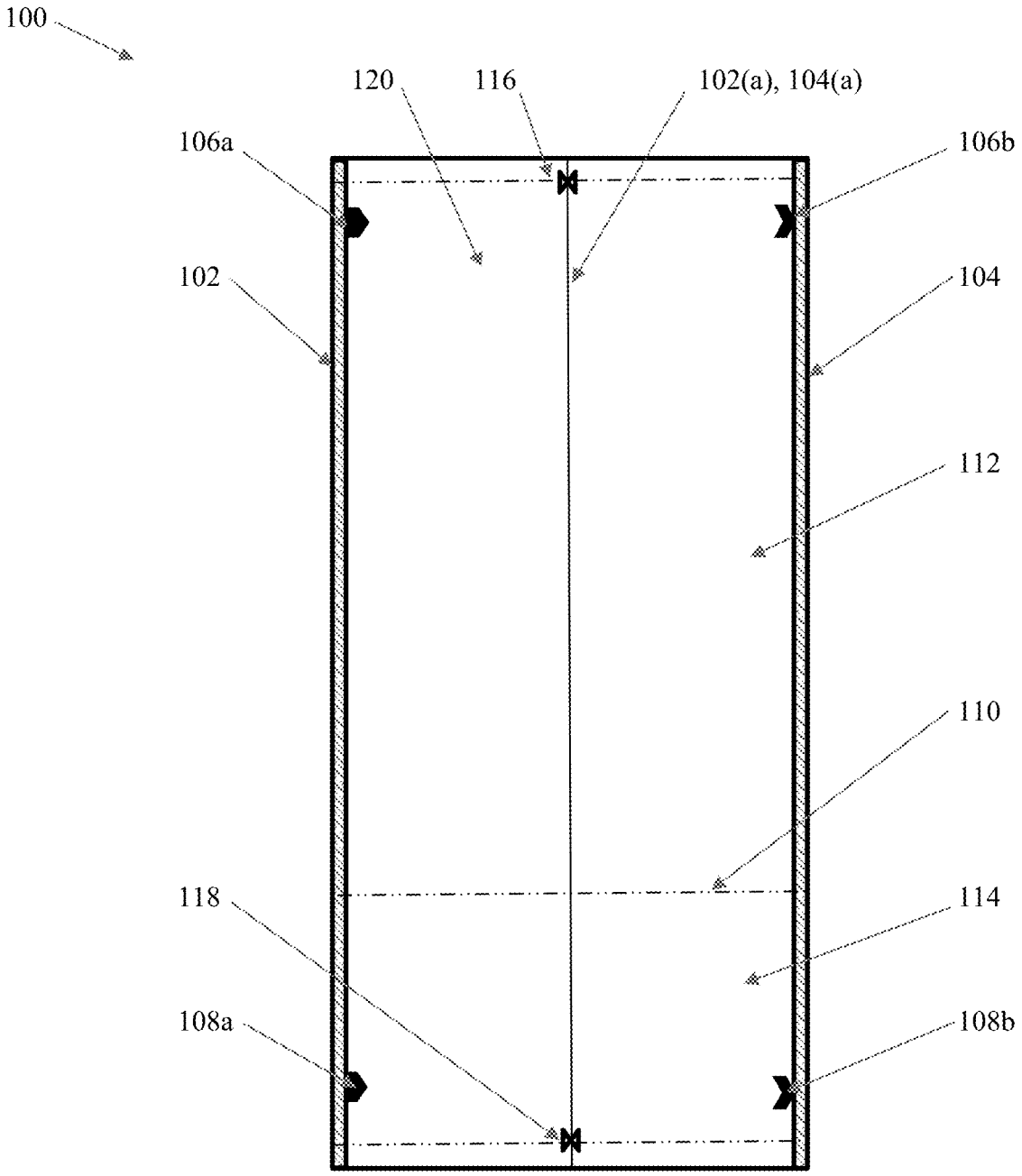
Figure 3A:
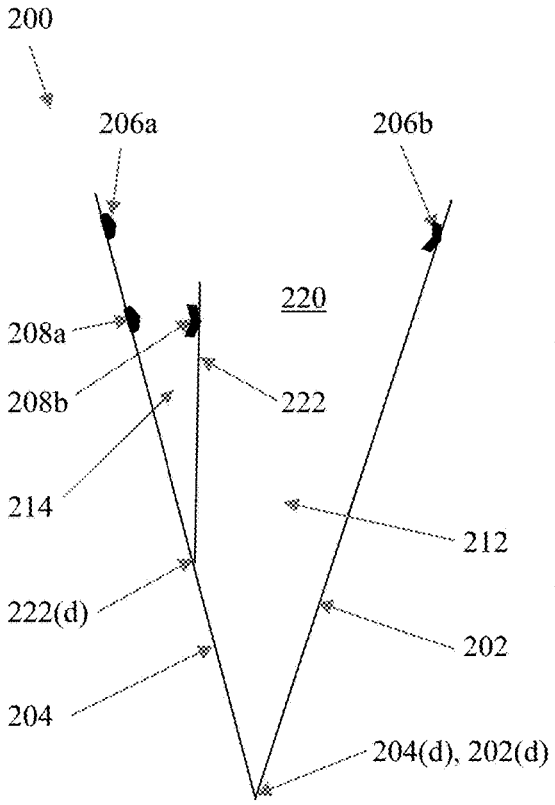
Figure 3B:
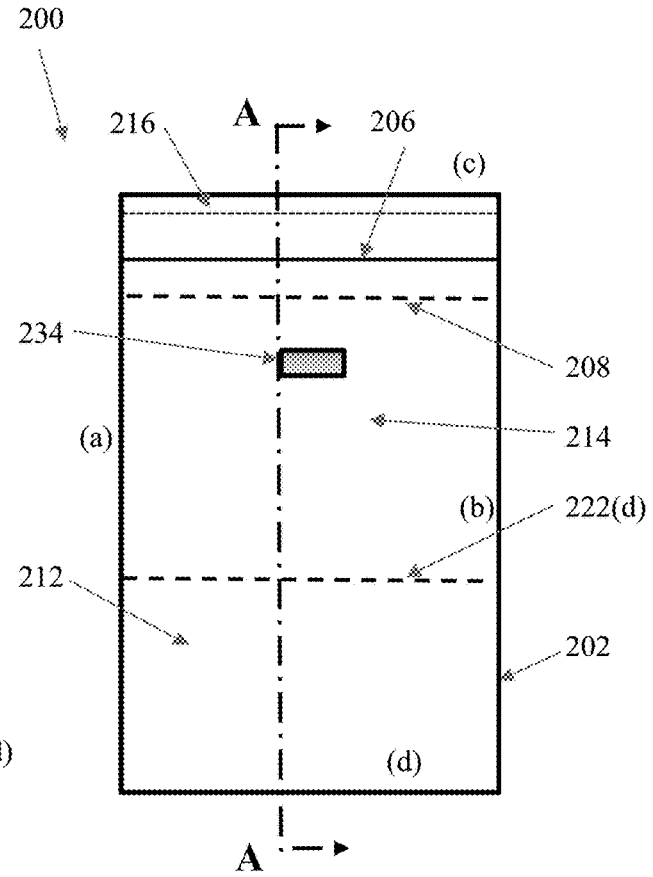
Figure 3C:
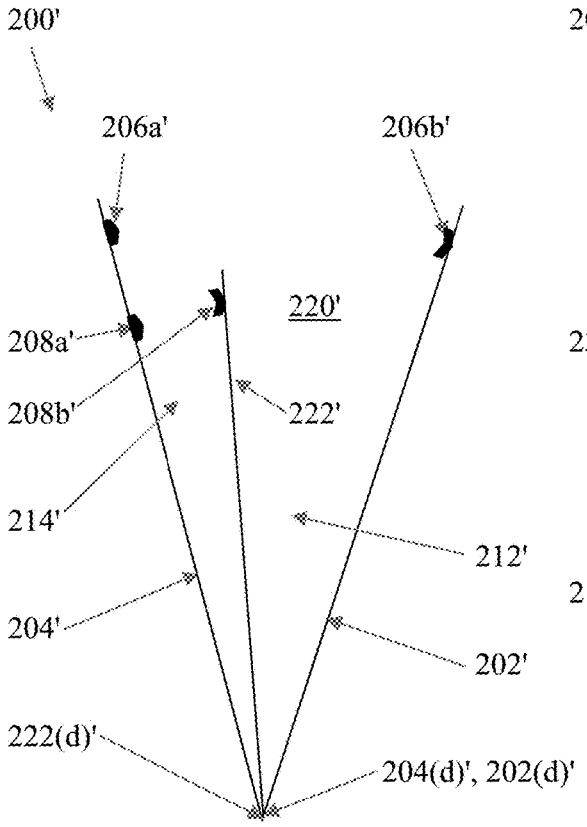
Figure 3D:
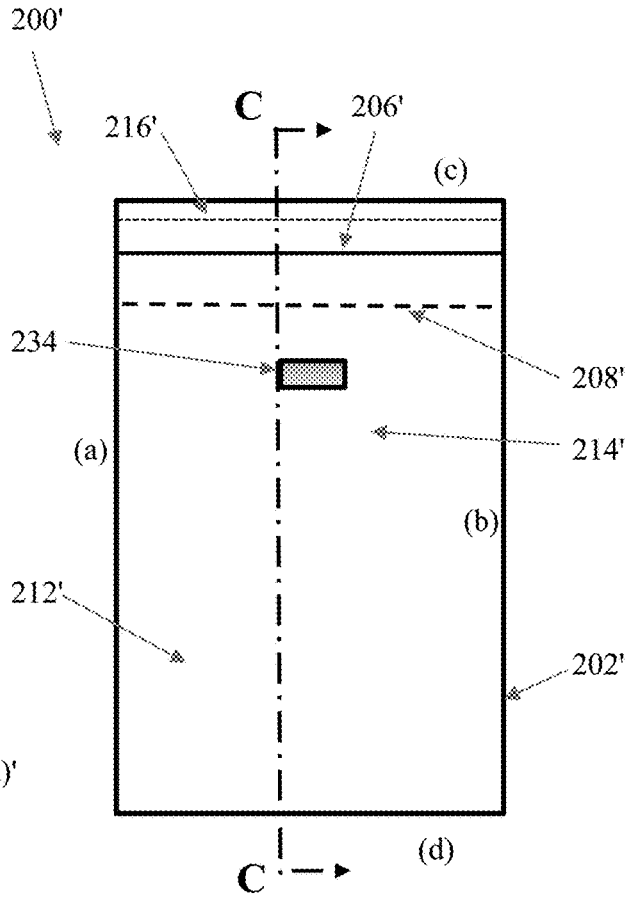
Figure 4A:
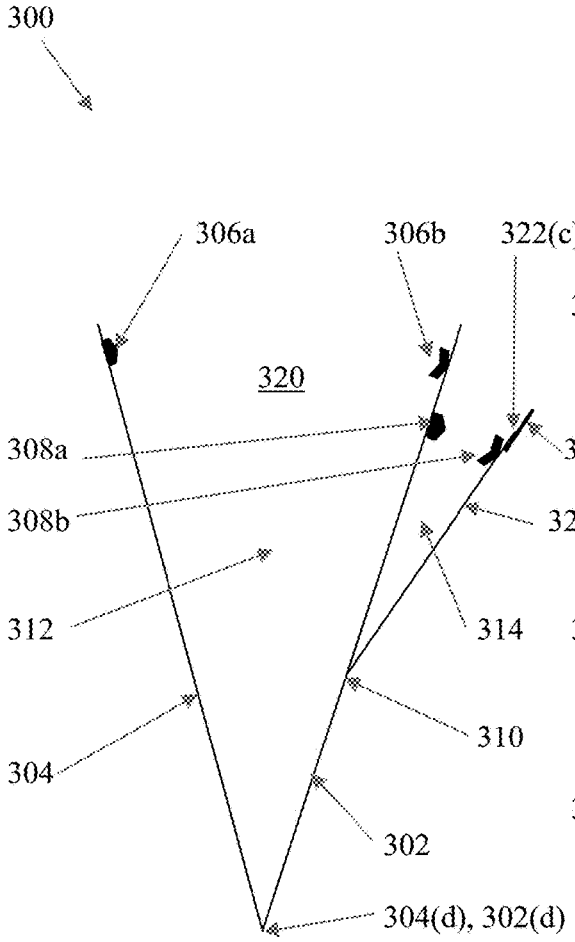
Figure 4B:
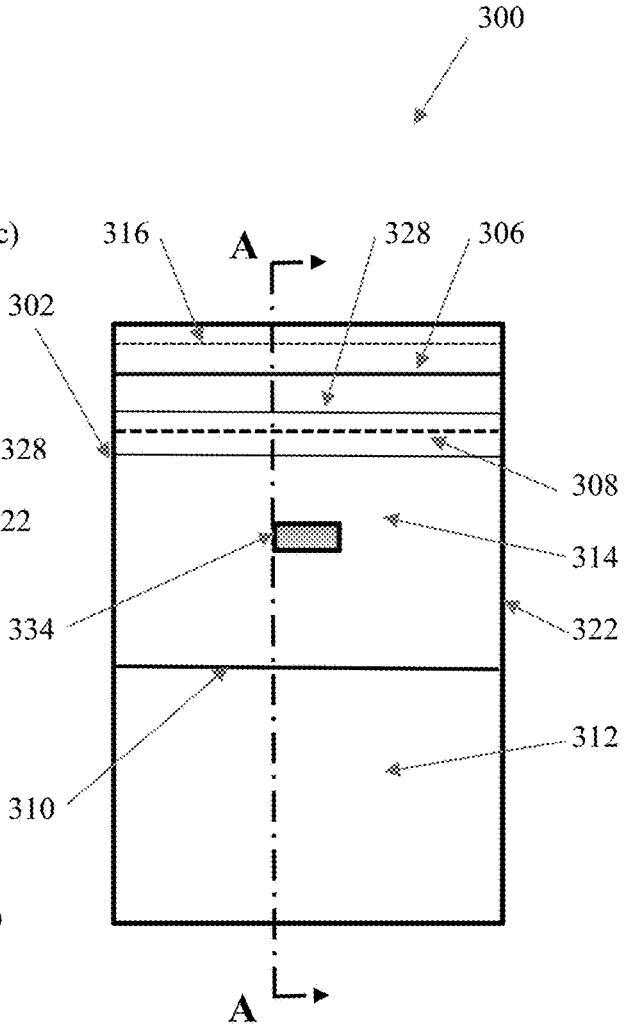
Figure 4C:
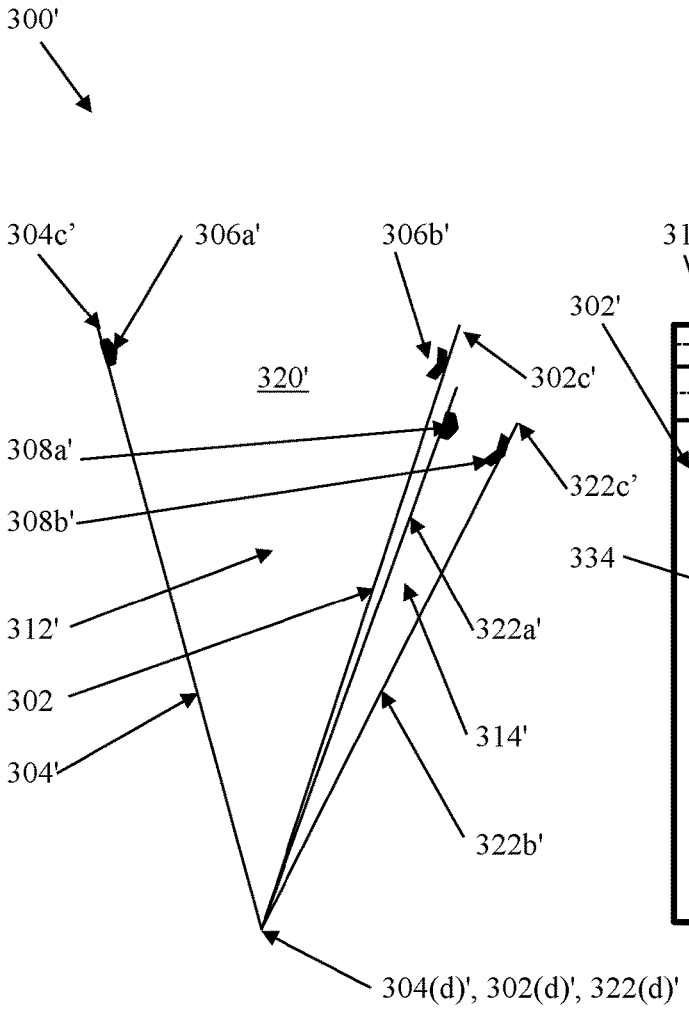
Figure 4D:
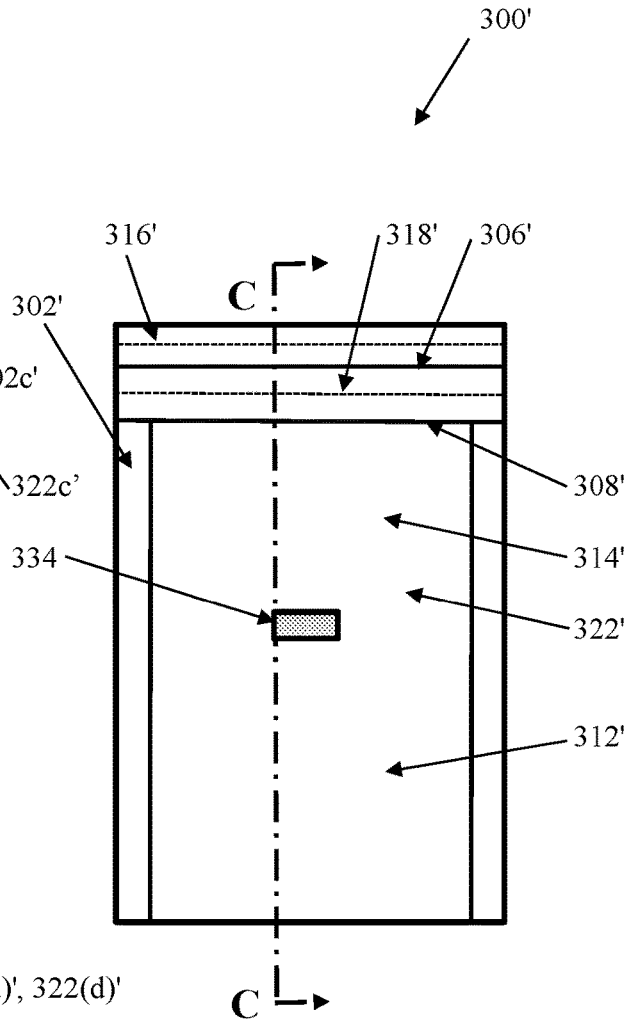
Figure 5:
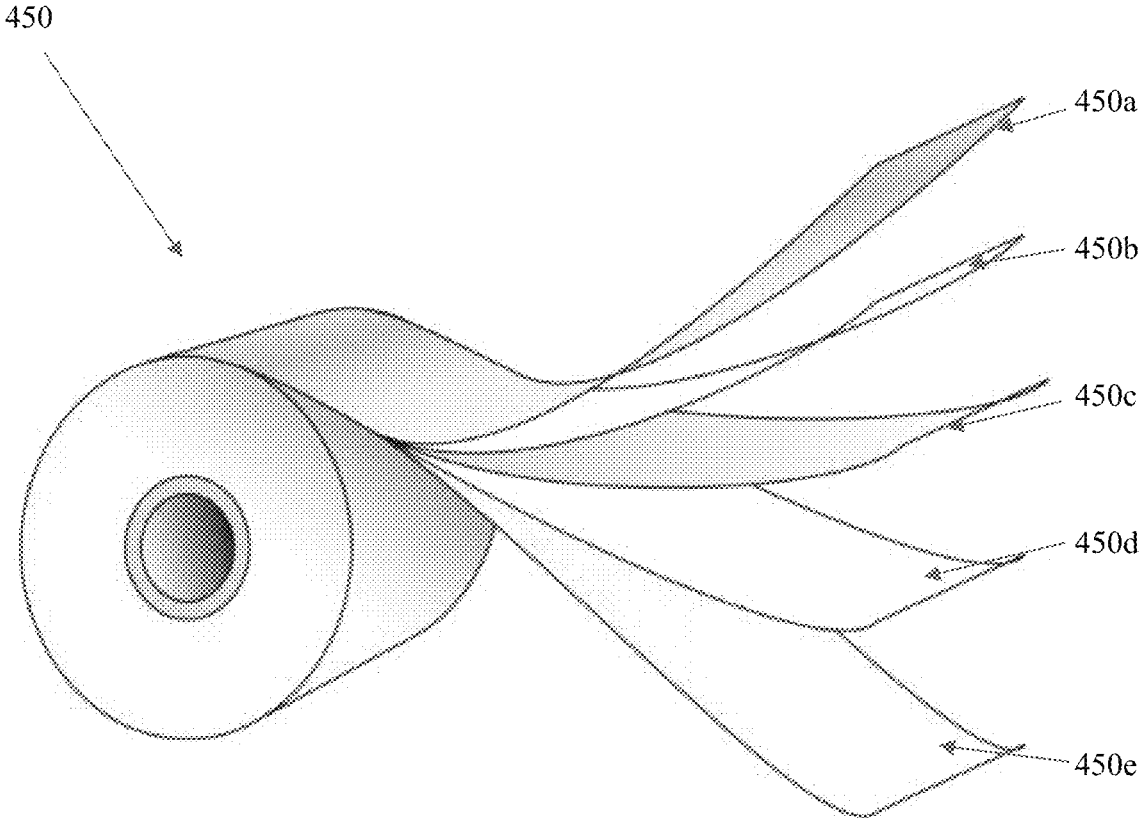

Having thus described aspects of the disclosure in the foregoing general terms, reference will now be made to the accompanying figures, which are not necessarily drawn to scale, and wherein:

FIGS. 1A, 1B, and 1C are schematic side and front views of a multi-compartment pouch container according to some example implementations;

FIG. 2A is schematic perspective view of the container of FIGS. 1A, 1B, and 1C in a partially assembled state according to some example implementations;

FIG. 2B is schematic cross-sectional view of the container of FIG. 2A in a partially assembled state according to some example implementations;

FIGS. 3A and 3B are schematic side and front views of an alternative multi-compartment pouch container according to some example implementations;

FIGS. 3C and 3D are schematic side and front views of an alternative configuration of the multi-compartment pouch container of FIGS. 3A and 3B;

FIGS. 4A and 4B are schematic side and front views of another alternative multi-compartment pouch container according to some example implementations;

FIGS. 4C and 4D are schematic side and front views of an alternative configuration of the multi-compartment pouch container of FIGS. 4A and 4B; and FIG. 5 is schematic side view of a roll of a panel material according to some example implementations.

DETAILED DESCRIPTION

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art. Like reference numerals refer to like elements throughout.

Unless specified otherwise or clear from context, references to first, second or the like should not be construed to imply a particular order. A feature described as being above another feature (unless specified otherwise or clear from context) may instead be below, and vice versa; and similarly, features described as being to the left of another feature else may instead be to the right, and vice versa. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Furthermore, it should be understood that unless otherwise specified, the terms "data," "content," "digital content," "information," and similar terms may be at times used interchangeably. Additionally, where multiples of the same components are described, the multiples may be referred to individually (e.g., ##a, ##b, ##c, etc.) or collectively (##).

Example implementations of the present disclosure are generally directed to containers or other packaging devices (e.g., packets, pouches, bags, sacks, cases, sachets, etc.) for holding a smokeless tobacco product or the like. Examples of which are disclosed in U.S. Pat. No. 4,838,429 to Fabisiewicz et al.; U.S. Pat. No. 5,222,813 Kopp et al; and U.S. Pat. No. 7,861,728 to Horton, Jr. et al.; U.S. Patent Publication Nos. 2007/0274615 to Deniaud et al.; 2008/0063324 to Bernard et al.; 2008/0302682 to Engstrom et al.; 2010/0262273 to Dose et al.; 2010/0300465 to Zimmermann; 2010/0262273 to Dose et al.; 2011/0240048 to Winterson et al.; and 2019/0183174; and PCT Publication Nos. WO01/22839 to Tabak; WO2004/002852 to Mathieu et al.; WO2004/095958 to Husselmann; WO2005/102863 to Chaturvedi; WO2007/036714 t Scammell; and WO2017/051165 to Burke; the disclosures of which are hereby incorporated by reference herein in their entireties.

FIGS. 1A, 1B, and 1C depict three different views of a container 100 for storing smokeless tobacco or other oral product and having multiple compartments. FIG. 1A is a side view of the container 100 without any material stored within the compartments 112, 114. The container 100 is generally shown having a flat, planar configuration when empty; however, there is a certain amount of empty space within the compartments and/or the materials are flexible to accommodate any product stored therein. FIG. 1B is a front view of the container 100 and depicts the container 100 with a generally rectangular shaped outline; however, size and shape of the container can vary to suit a particular application, e.g., type of product, quantity of product, and size or shape of product. FIG. 1C is an opposite side view of the container 100 depicting two compartments 112, 114 with materials stored therein. For example, compartment 112 may be configured to hold a fresh tobacco product, while compartment 114 may be configured to hold a waste product (e.g., used chew).

As shown in FIGS. 1A, 1B, and 1C; the container 100 includes a front panel 102 and a back panel 104, where these panels comprise first and second lateral sides (a), (b) and first and second longitudinal ends (c), (d) that define substantially equal perimeters of each panel. The mating lateral sides (a), (b) of the front and back panels 102, 104 are bonded together to define an inner cavity 120 (shown best in FIGS. 2A and 2B) with openings at each end defined by the corresponding first and second longitudinal ends (c), (d) (essentially having a sleeve-like shape as shown in FIG. 2A that may be separated into multiple compartments are described below). The lateral sides (a), (b) may be bonded via sonic welding, heat sealing, an adhesive, or other known means for bonding films. In some implementations, the front and back panels are made of a single piece of material, where the lateral side (a) is a folded and creased border, with only the second lateral sides (b) bonded to one another. In yet other implementations, a "sleeve" can be extruded, flattened and cut at particular intervals to create the basic container with open ends.

In addition, the container 100 includes a transverse border or divider wall 110 extending between the lateral sides (a), (b) (also referred to as 102(*a*), 104(*a*), 102(*b*), and 104(*b*)) that is essentially a sealed line that divides the inner cavity 120 into a first compartment 112 and a second compartment 114. The first compartment 112 may be configured to hold a fresh product, such as chewing tobacco, snus, or oral products, while the second compartment 114 may be configured to hold a used or waste product. The second compartment 114 in FIGS. 1A-1C is generally shown as slightly smaller than the first compartment 112; however, the size of the second compartment 114 relative to the first compartment 112 may vary to suit a particular application. For example, the sizes (i.e., volume) of first and second compartments 112, 114 may be substantially equal or the volume of the second compartment 114 may be about 90%, about 80%, about 70%, about 60%, or about 50% of the volume of the first compartment 112.

Each compartment 112, 114 includes a closure mechanism 106, 108 disposed proximate their respective distal ends. The closure mechanisms 106, 108 are positioned a small distance inward of the longitudinal ends (c), (d) (also referred to as 102(*c*), 104(*c*), 102(*d*), and 104(*d*)) to allow for tear-open transverse seals 116, 118 between the closure mechanisms 106, 108 and the longitudinal ends (c), (d) to prevent accidental opening or tampering before purchased by the user. The fully sealed container 100 is typically air-tight; however, in some implementations, the panel materials may be configured to, for example, allow pressure within the compartments to vent or allow certain gases (e.g., oxygen) to pass through the materials, as described in greater detail below.

The closure mechanisms 106, 108 may be selected to suit a particular application and may include zipper-type closures (e.g., Ziploc® as available from SC Johnson) or similar snap-fit type closure mechanisms, an adhesive, a hook and loop type fastener (e.g., Velcro® as available from the Velcro Company), and folding. Typically, the closure mechanisms 106, 108 are two-part mechanisms, with a first part 106*a*, 108*a* disposed on the front panel 102 (e.g., proximate longitudinal end (a)) and a second part 106*b*, 108*b* disposed on the back panel 104 (e.g., proximate longitudinal end (b)). See FIG. 2B. The two parts are brought into contact with one another to effect sealing (e.g., via a slider or application of a force (i.e., press and seal)). The closure mechanism halves 106*a*, 106*b*, 108*a*, 108*b* may be attached to the panels via any of the manners known to a person of the skill in the art (e.g., sonic welding, adhesive, etc.).

The tear-open transverse seals 116, 118 are typically formed as known to a person of skill in the art (see, e.g., U.S. Pat. No. 5,222,813, incorporated herein by reference) and include a sealed portion 116, 118 that runs the width of the container 100 and intersecting the lateral side seals at an angle and tear-open slits 116*a*, 116*b*, 118*a*, 118*b* disposed proximate thereto. Generally, the slits 116*a*, 116*b*, 118*a*,

118*b* may be a simple cut through the panel layers with a single blade and without removing any material. The tear-open slits are disposed proximate the seals 116, 118, but do not penetrate far across the width of the panels 102, 104 so as to ensure that the seal of the container 100 is not endangered. The tear-open slits aid in initiating the tearing of the end of the container 100 such that the user may easily produce a tear that extends parallel to the seals 116, 118 and results in a full severance of an end portion of the container 100 where the seals 116, 118 and the tear-open slits 116*a*, 116*b*, 118*a*, 118*b* are provided. The container 100 is shown with slits disposed on both lateral sides of the container; however, in some implementations, only a single tear-open slit is provided.

In use, the user (i.e., consumer) tears off the tear-open transverse seal 116, thereby providing access to the opening of the first compartment 112, sealed or unsealed depending on the state of the closure mechanism 106. If sealed, the user opens the closure mechanism 106 so as to access a product within the first compartment 112. After removing a product portion (e.g., a pinch or dip), the user can reseal the first compartment 112 by closing the closure mechanism 106, thereby maintaining the freshness of the product. Similarly, once the user is done with the product, the user tears off the tear-open transverse seal 118 disposed at the opposite end of the container 100, thereby providing access to the opening of the second compartment 114, which may be open or closed depending on the state of the closure mechanism 108. If closed, the user opens the closure mechanism 108 so as to access the space within second compartment 114. The user may place the used product (i.e., waste) into the second compartment 114 and seal the second compartment 114 by moving the closure mechanism 208 into the closed configuration, thereby preventing leakage from the waste compartment. FIG. 1C depicts the container 100 in use, where a fresh product 130 is stored within the first compartment 112 and a waste product 132 is stored within the second compartment 114.

FIGS. 2A and 2B depict the container 100 of FIGS. 1A-1C in various states of assembly. Specifically, FIG. 2A depicts the front and back panels 102, 104 bonded along their lateral sides 102(*a*), 104(*a*) and 102(*b*), 104(*b*) and defining an inner cavity 120 with their open longitudinal ends 102(*c*), 104(*c*) and 102(*d*), 104(*d*) creating a sleeve-like shape (as shown) or in a flat configuration (FIG. 1B). The closure mechanisms are not shown, but the tear open slits 116*a*, 116*b*, 118*a*, 118*b* are shown, although may be added last as slits or notches. Besides attachment of the closure mechanisms, the container 110 needs be flattened and the three additional seals applied at the positions represented by the dashed lines; 110 for the divider wall and 116, 118 for the tear-open transverse seals.

In some implementations, two rolls of materials (e.g., a continuous multi-layer web for a front panel and a continuous multi-layer web for the back panel) may be feed to a machine where the lateral sides may be ultrasonically welded to form the sleeve configuration, with the machine cutting the sleeves at certain set lengths. Additionally, the machine may also create the seal for the divider wall 110 during the process. The closure mechanisms 206, 208, along with the transverse seals 116, 118, may be applied during a later process. In addition, indicia (or indicium) 134 may be applied to the outer sides of the front and back panels during the process (e.g., a date code) and/or the materials may be pre-printed (e.g., package logo or other ornamentation). In some implementations, the indicia may comprise letters, numbers, colors, symbols or combinations thereof that function as a warning or a designation of use to a consumer. For example, the indicia may indicate a function of a particular component, such as identifying the waste compartment as such, so that the consumer does not access the wrong compartment.

FIG. 2B depicts a cross-sectional view of the sleeve of FIG. 2A taken at line B-B of FIG. 2A. As shown, the closure mechanisms 106, 108 are installed, with the first halves 106*a*, 108*a* coupled to the inner side of the front panel 102 and the second, mating halves 106*b*, 108*b* coupled to the inner side of the back panel 104.

FIGS. 3A and 3B depict an alternative implementation of a container 200, where the second compartment 214 is located within the first or main compartment 212, as opposed to the container of FIGS. 1A-1C, where the first and second compartments 112, 114 are disposed at opposite ends of the container 100. FIG. 3A is essentially a cross-sectional view taken at line A-A of FIG. 3B, which is a front or plan view of the container 200. Similar to container 100, container 200 includes a front panel 202 and a back panel 204, where these panels comprise first and second lateral sides (a), (b) and first and second longitudinal ends (c), (d) that define substantially equal perimeters of each panel. The mating lateral sides (a), (b) of the front and back panels 202, 204, along with the second longitudinal end (d), are bonded together to define an inner cavity 220 with an opening defined by the corresponding first longitudinal ends (c) (e.g., 202(*c*), 204(*c*)), thereby creating a pouch. The lateral sides (a), (b) may be bonded via sonic welding, heat sealing, an adhesive, or other known means for bonding films. In some implementations, the front and back panels are made of a single piece of material, where either the lateral side (a) or the second longitudinal end (d) is a folded and creased border, with only the remaining lateral side or second longitudinal end bonded to one another. In some implementations, a "sleeve" can be extruded, flattened, sealed at one end, and cut at particular intervals to create the basic container with a single open end.

In addition, the container 200 includes an intermediate panel 222 disposed within the inner cavity 220. Generally, the panel 222 is bonded to one of the inner walls of the front panel 202 or back panel 204 to form the second compartment 214 within the inner cavity 220, the remainder of which is the first compartment 212. The intermediate panel 222 also comprises first and second lateral sides and first and second longitudinal ends that define a perimeter of the panel 222. As shown, the intermediate panel 222 has a width that is substantially equal to the widths of the front and back panels 202, 204, such that the lateral sides of the intermediate panel 222 may be bonded to the lateral sides of the front and back panels 202, 204 at the same time that the front and back panels are bonded together. The second longitudinal end 222(*d*) is then bonded to the inner side of either the front or back panel 202, 204 to create the second compartment 214. In some implementations, the width of the intermediate panel 222 is narrower than the front and back panels 202, 204, in which case the lateral sides of the intermediate panel are separately bonded to the same inner side as the second longitudinal end 222(*d*). In some implementations, the indicia 234 may be located on the intermediate panel 222 as opposed to the front or back panel.

As described with respect to FIGS. 1A-1C, the first compartment 212 may also be configured to hold a fresh product, such as chewing tobacco, snus, or an oral product, while the second compartment 214 may be configured to hold a used or waste product. The second compartment 214 is generally shown with the same width, but a shorter length, as the first compartment 212; however, the size of the second compartment 214 relative to the first compartment 212 may vary to suit a particular application, and in some implementations, may have a length substantially similar to the first compartment 212. For example, as shown in FIGS. 3C and 3D, the intermediate panel 222' may have a length slightly less than the front and back panels 202', 204', such that the second longitudinal end 222(*d*)' of the intermediate panel 222' is aligned with and bonded with the second longitudinal ends 202(*d*)', 204(*d*)' of the front and back panels 202', 204', and the first longitudinal end of the intermediate panel 222' terminates short of the first longitudinal ends 202(*c*)', 204(*c*)' of the front and back panels so as to accommodate a closure mechanism for the second compartment 214' within the first compartment 212'. In various implementations, the volumes of first and second compartments 212, 212', 214, 214' may be substantially similar, or the volume of the second compartment 114 may be about 90%, about 80%, about 70%, about 60%, or about 50% of the volume of the first compartment 212, 212'.

Each compartment 212, 214 includes a closure mechanism 206, 208 disposed proximate their respective distal ends. The closure mechanisms 206, 208 are positioned a small distance inward of their first longitudinal ends (c) (also referred to as 202(*c*), 204(*c*), 222(*c*)). With respect to the first closure mechanism 206, it is positioned to allow for a tear-open transverse seal 216 between the closure mechanism 206 and the longitudinal ends 202(*c*), 204(*c*), as described above. Generally, a tear-open transverse seal is not required for the second compartment 214, because it is located within the inner cavity 220/first compartment 212. The types and methods of incorporation of the closure mechanisms 206, 208 can be the same as those described above, as can the overall method of manufacture of the container 200, 200'. In some embodiments, the two closure mechanisms 206, 208 may be coupled in a manner such that opening closure mechanism 206 also opens closure mechanism 208. Alternatively, the wall (i.e., intermediate panel 222) of the waste compartment 214 may extend so as to be co-extensive with the first longitudinal end (c) of the back panel 204 (or front panel 102 as the case may be) such that both compartments 212, 214 are closed by the single closure mechanism 206. Additionally, in some embodiments, two different types of closure mechanisms may be used, such as, for example, a zipper-type outer closure mechanism and an adhesive-type inner closure mechanism.

In use, the user tears off the tear-open transverse seal 216, thereby providing access to the opening of the first compartment 212 and the second compartment 214, either sealed or unsealed depending on the state of their respective closure mechanisms 206, 208. If sealed, the user opens the closure mechanism 206 so as to access the product within the first compartment 212. After removing a product portion, the user can reseal the first compartment 212 by closing the closure mechanism 206, thereby maintaining the freshness of the product. Similarly, once the user is done with the product, the user may reopen the first closure mechanism 206, thereby providing access to the opening of second compartment 214, which may be open or closed (preferably closed) depending on the state of the closure mechanism 208. If closed, the user opens the closure mechanism 208 so as to access the space within second compartment 214. The user may place the used product (i.e., waste) into the second compartment 214 and seal the second compartment 214 by transitioning the second closure mechanism 208 and then the first closure mechanism 206 into their closed configurations.

FIGS. 4A and 4B depict another alternative implementation of a container 300, where the second compartment 314 is located outside of the first or main compartment 312, as opposed to the container of FIGS. 1A-1C, where the first and second compartments 112, 114 are disposed at opposite ends of the container 100. FIG. 4A is essentially a cross-sectional view taken at line A-A of FIG. 4B, which is a front or plan view of the container 300. Similar to container 100, container 300 includes a front panel 302 and a back panel 304, where these panels comprise first and second lateral sides (a), (b) and first and second longitudinal ends (c), (d) that define substantially equal perimeters of each panel. The mating lateral sides (a), (b) of the front and back panels 302, 304, along with the second longitudinal end (d), are bonded together to define an inner cavity 320 with an opening defined by the corresponding first longitudinal ends (c) (e.g., 302(*c*), 304(*c*)), thereby creating a pouch. The lateral sides (a), (b) may be bonded via sonic welding, heat sealing, an adhesive, or other known means for bonding films. In some implementations, the front and back panels are made of a single piece of material, where either the lateral side (a) or the second longitudinal end (d) is a folded and creased border, with only the remaining lateral side or second longitudinal end bonded to one another. In some implementations, a "sleeve" can be extruded, flattened, sealed at one end, and cut at particular intervals to create the basic container with a single open end.

In addition, the container 300 includes an intermediate panel 322 disposed outside the inner cavity 320 and bonded to one of the outer sides of the front 302 or back panel 304 to form the second compartment 314 outside of the inner cavity 320. The intermediate panel 322 also comprises first and second lateral sides and first and second longitudinal ends that define a perimeter of the panel 322. As shown, the intermediate panel 322 has a width that is substantially equal to the widths of the front and back panels 302, 304, such that the lateral sides of the intermediate panel 322 may be bonded to the lateral sides of the front and back panels 302, 304 at the same time that the front and back panels are bonded together. The second longitudinal end 322(*d*) is then bonded to the outer side of either the front or back panel 302, 304 to create the second compartment 314. In some implementations, the width of the intermediate panel 322 is narrower than the front and back panels 302, 304, in which case the lateral sides of the intermediate panel are separately bonded to the same outer side as the second longitudinal end 322(*d*) (see FIG. 4D). In the container 300 depicted in FIG. 4B, the indicia 334 is disposed on the outer surface of the intermediate panel 322.

Similar to the containers described above, the first compartment 312 may also be configured to hold a fresh product, such as chewing tobacco, while the second compartment 314 may be configured to hold a used or waste product. The second compartment 314 is generally shown with the same width, but a shorter length, as the first compartment 312; however, the size of the second compartment 314 relative to the first compartment 312 may vary to suit a particular application, and in some implementations, may have a length substantially similar to the first compartment 312. For example, as shown in FIGS. 4C and 4D, the intermediate panel 322' may have a length slightly less than the front and back panels 302', 304', such that the second longitudinal end 322(*d*)' of the intermediate panel 322' is aligned with and bonded with the second longitudinal ends 302(*d*)', 304(*d*)' of the front and back panels 302', 304', and the first longitudinal end 322(*c*)' of the intermediate panel 322' terminates short of the first longitudinal ends 302(*c*)', 304(*c*)' of the front and back panels so as to accommodate a closure mechanism 306' for the second compartment 314' proximate the opening of the first compartment 312'. In various implementations, the volumes of first and second compartments 312, 312', 314, 314' may be substantially similar, or the volume of the second compartment 114 may be about 90%, about 80%, about 70%, about 60%, or about 50% of the volume of the first compartment 312, 312'.

Each compartment 312, 314 includes a closure mechanism 306, 308 disposed proximate their respective distal ends. The closure mechanisms 306, 308 are positioned a small distance inward of their first longitudinal ends (c) (also referred to as 302(*c*), 304(*c*), 322(*c*)). With respect to the first closure mechanism 306, it is positioned to allow for a tear-open transverse seal 316 between the closure mechanism 306 and the longitudinal ends 302(*c*), 304(*c*), as described above. In some implementations, a second tear-open transverse seal 318 is provided between the second closure mechanism 308 and the longitudinal end 322(*c*) to provide access to the second compartment 314 closure mechanism 308. Because the intermediate panel 322 is a single panel and it is not desirable to have a tear-open transverse seal between the intermediate panel 322 and the front or back panel 302, 304, depending to whose outer side the panel 322 is attached.

Accordingly, in certain implementations where the second compartment 314' is disposed outside of the first compartment 312', two intermediate panels 322', 322" may be required such that the tear-open transverse seal 318' may be disposed between the two intermediate panels 322', 322" as shown in FIG. 4C. In some implementations, the entire or substantially the entire back surface and/or perimeter of the first intermediate panel 322' is bonded to the outer side of the front or back panel 302', 304', as the case may be, to securely attach the second compartment 314' to the first compartment 312'.

Alternatively, the tear-open transverse seal may be replaced with a peel strip 328 (FIG. 4A) that sealingly secures the first longitudinal end 322(*c*) of the intermediate panel 322 to the outer side of the front or back panel 302, 304, as the case may be. The peel strip 328 performs the same function as the tear-open seal insofar as preventing accidental opening or tampering of the container and product therein before its purchased by the user. The peel strip 328 may include a tamper evidence feature. Otherwise, the types and methods of incorporation of the closure mechanisms 306, 308 can be the same as those described above, as can the overall method of manufacture of the container 300, 300'.

In use, the user tears off the first tear-open transverse seal 316, thereby providing access to the opening of first compartment 312, either sealed or unsealed depending on the state of its closure mechanism 306. If sealed, the user opens the closure mechanism 306 so as to access the product within the first compartment 312. After removing a product portion, the user can reseal the first compartment 312 by closing the closure mechanism 306, thereby maintaining the freshness of the product. Similarly, once the user is done with the product, the user tears off the second tear-open transverse seal 318' (or removes the peel strip 328), thereby providing access to the opening of the second compartment 314, which may be open or closed depending on the state of its closure mechanism 308. If closed, the user opens the closure mechanism 308 so as to access the space within second compartment 314. The user may place the used product (i.e., waste) into the second compartment 314 and seal the second compartment 314 by transitioning the closure mechanism 308 into the closed configuration.

FIG. 5 depicts a roll of an exemplary material 450 for use as any of the panels described above and may include a lamination of paper/poly/metal/poly layers. The material 450 shown includes five layers, three basic or functional layers 450*a*, 450*c*, 450*e*, and two adhesive layers 450*b*, 450*d* disposed there between. The first functional layer 450*a* is typically a printing layer for application of, for example, a high quality decoration, logo, etc. In some implementations, the first layer 450*a* is a 12 μm polyester (PET) film, however, the material and thickness this or any of the other layers may vary for a particular application. The first layer 450*a* may be configured for reverse printing making the inks, and by extension, logos, etc. scratch-proof. Additionally, the first layer 450*a* may have a matte, gloss, or combination finish, a textured surface, a surface varnish or other finishes as known to a person of skill in the art.

The second functional layer 450*c* is a barrier layer for maintaining product integrity and may be a 12 μm metalized polyester (MPET) film. The second functional layer 450*c* may be configured to provide a high moisture barrier, i.e., configured to be substantially fluid-impervious so as to prevent the flow of fluids from the internal compartments to the ambient environment. However, in some implementations, the second functional layer may include a material configured to allow for oxygen (or other gas) to diffuse into or out of the compartments while substantially resisting moisture loss therethrough.

The third functional layer 450*e* is a sealing layer, which also helps maintain product integrity. In some implementations, the third functional layer 450*e* may comprise a polyethylene material having a thickness in a range of about 55 μm to about 80 μm. In a particular implementation, the third functional layer 450*e* is a 70 μm low density polyethylene (LDPE) film. The third functional layer is the product contact layer and, depending on the product, may require regulatory approval for direct product contact. The adhesive layers 450*b*, 450*d* are provided to form a lamination or film that is used for the various panels as are known to a person of skill in the art. In various implementations, the materials used to manufacture the container render the container totally recyclable.

For example, the materials used for the container panels and the various other components (e.g., closure mechanisms, indicia, etc.) may comprise a biodegradable material, such as, for example, biodegradable starch-based materials, cellulosic materials (cellulose and cellulosic derivatives), biodegradable synthetic materials, and polymers of lactic acid and its derivatives, polymers of hydroxyalkanoates, biodegradable polyesters, and polycaprolactones. Biodegradability can be measured, for example, by placing a sample in environmental conditions expected to lead to decomposition, such as placing a sample in water, a microbe-containing solution, a compost material, or soil. The degree of degradation can be characterized by weight loss of the sample over a given period of exposure to the environmental conditions. U.S. Pat. No. 5,970,988 to Buchanan et al. and U.S. Pat. No. 6,571,802 to Yamashita provide example test conditions for degradation testing. The degradability of a plastic material also may be determined using one or more of the following ASTM test methods: D5338, D5526, D5988, and D6400.

The sizes and shapes of the various containers disclosed herein may vary to suit a particular application and include any combination of polygonal and arcuate elements. In some implementations, the containers may have a common width with lengths that vary to suit particular sizes. The width of the container may range from about 40 mm to about 200 mm, preferably about 75 mm to about 150 mm, more preferably about 80 mm to about 120 mm. and in one implementation, about 90 mm. The lengths will vary to hold a particular amount of product and may range from about 50 mm to about 300 mm, preferably about 50 mm to about 200 mm, and more preferably about 75 mm to about 150 mm. In certain implementations, the lengths correspond to certain size designations that represent specific product quantities, such as, for example, about 76 mm (a mini-pouch for holding 5 snus pouches), about 110 mm (a medi-pouch for holding 10 snus pouches), or about 160 mm (a maxi-pouch for holding 20 snus pouches). It should be noted, that a certain portion of the container lengths will be reserved for the closure mechanisms and not available for holding a product. The length will vary depending on the particular closure mechanism used and may range from about 10 mm to about 40 mm, preferably about 20 mm to 30 mm, and more preferably about 28 mm.

Although directional terms such as top, bottom, front, back, etc. have been employed herein, it should be understood that these terms have been provided for explanatory purposes only. In this regard, the blanks and packages disclosed herein may be employed in other configurations and orientations beyond those described above.

Many modifications and other implementations of the disclosure will come to mind to one skilled in the art to which this disclosure pertains having the benefit of the teachings presented in the foregoing descriptions and the associated figures. Therefore, it is to be understood that the disclosure is not to be limited to the specific implementations disclosed herein and that modifications and other implementations are intended to be included within the scope of the appended claims. Although specific terms are employed herein, they are used in a generic and descriptive sense only and not for purposes of limitation.

What is claimed is:

1. A multi-compartment container comprising:

a front panel having a perimeter defined by two lateral sides and first and second longitudinal ends;

a back panel having a perimeter defined by two lateral sides and first and second longitudinal ends, the perimeter of the back panel sealingly coupled to the perimeter of the front panel along their respective lateral sides, thereby defining an inner cavity and a first open end defined by the first longitudinal end of the front panel and the first longitudinal end of the back panel and a second open end defined by the second longitudinal end of the front panel and the second longitudinal end of the back panel;

a divider wall extending between the sealed lateral sides of the front and back panels and configured to divide the inner cavity into a first compartment and a second compartment;

a first closure mechanism disposed proximate the first open end and configured to transition the first compartment between an open configuration and a closed configuration via a zipper-type closure or a snap-fit type closure;

a first transverse seal disposed between the lateral sides of the front and back panels and positioned between the first closure mechanism and the first open end, wherein the first transverse seal comprises a tear open feature for accessing the first closure mechanism and the first compartment; and a second closure mechanism disposed proximate the second open end and configured to transition the second compartment between an open configuration and a closed configuration via a zipper-type closure or a snap-fit type closure, wherein the second compartment is accessible via the second closure mechanism.

2. The container of claim 1, wherein the first transverse seal comprises a tamper evidence feature.

3. The container of claim 2 further comprising a second transverse seal disposed between the lateral sides of the front and back panels and positioned between the second closure mechanism and the second open end, wherein the second transverse seal comprises a tear open feature for accessing the second closure mechanism and the second compartment.

4. The container of claim 1, wherein the divider wall is formed via sonic welding or heat sealing between the front panel and the second panel.

5. The container of claim 1, wherein each of the front and back panels comprise a lamination of at least three layers.

6. The container of claim 5, wherein the three layers comprise an outer printing layer comprising a polyester, a high moisture barrier middle layer comprising a metalized polyester, and an inner sealing layer comprising a low density polyethylene.

7. The container of claim 1, wherein the first compartment comprises a first volume and the second compartment comprises a second volume that is about 50% of the volume of the first compartment.

8. The container of claim 7, wherein the first compartment is configured to hold a fresh product and the second compartment is configured to hold a waste product.

9. The container of claim 1, wherein a surface of the front panel and/or a surface of the back panel are configured to be printed with indicia.

10. The container of claim 9, wherein the indicia comprise one or more of a letter, a number, a symbol, a color, or any combination thereof to indicate a function.

* * * * *